United States Patent [19]

Hyland et al.

[11] 3,966,295

[45] June 29, 1976

[54] TERMINATING APPARATUS FOR FLAT CONDUCTOR CABLES

[75] Inventors: Anthony Joseph Hyland, Delran, N.J.; Wade William Crossley, Bristol, Pa.

[73] Assignee: Elco Corporation, Willow Grove, Pa.

[22] Filed: June 17, 1974

[21] Appl. No.: 480,314

[52] U.S. Cl. ..... 339/176 MF; 339/217 S

[51] Int. Cl.[2] ..... H01R 13/50; H01R 9/16

[58] Field of Search ..... 339/217 R, 217 S, 99 R, 339/17 F, 176 MF, 258 R, 258 P, 97 C, 98

[56] References Cited

UNITED STATES PATENTS

| | | | |
|---|---|---|---|
| 3,363,217 | 1/1968 | Garver et al. | 339/217 S |
| 3,538,489 | 11/1970 | Bennett et al. | 339/217 S |
| 3,550,067 | 12/1970 | Hansen | 339/217 S |
| 3,566,342 | 2/1971 | Schmitt et al. | 339/258 P X |
| 3,697,925 | 10/1972 | Henschen | 339/217 R |
| 3,711,819 | 1/1973 | Mathews | 339/217 S |
| 3,813,634 | 5/1974 | Wisby et al. | 339/176 MF |
| 3,840,840 | 10/1974 | Worth | 339/176 MF |

FOREIGN PATENTS OR APPLICATIONS

| | | | |
|---|---|---|---|
| 2,036,990 | 2/1971 | Germany | 339/258 R |
| 461,598 | 10/1968 | Switzerland | 339/258 P |

*Primary Examiner*—Joseph H. McGlynn
*Assistant Examiner*—James W. Davie
*Attorney, Agent, or Firm*—Burns, Doane, Swecker & Mathis

[57] ABSTRACT

Terminating apparatus for a flat conductor cable including a plurality of generally coplanar individual conductors. The terminating apparatus includes a generally rectangular insulation housing having an array of longitudinally extending apertures with mutually parallel and coplanar axes. A box contact assembly is positioned within each housing aperture and includes a contact tail for simultaneously providing a secure structural and electrical connection to an associated one of the plurality of individual conductors and a contact nose for providing a releasable electrical connection to another associated one of a plurality of mating conductors. Each box contact assembly is fashioned with a resilient locking lance which operates in cooperation with a recess fashioned within one wall of each aperture within the insulation housing to releasably maintain the conductor cable within the insulation housing. Each box contact assembly is further fashioned with a generally U-shaped section including a relatively long leg which operates in cooperation with a recess in each housing aperture to ensure proper polarization or orientation of the flat conductor cable within the insulation housing.

4 Claims, 12 Drawing Figures

FIG. 1
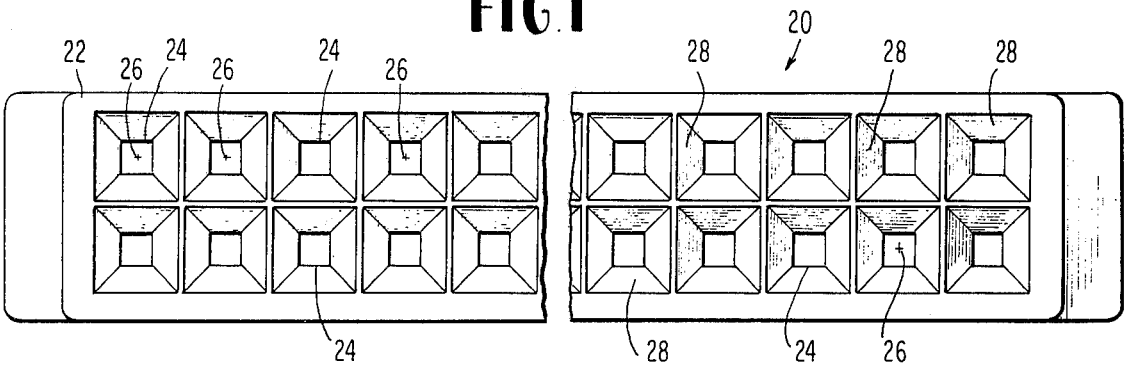
FIG. 2
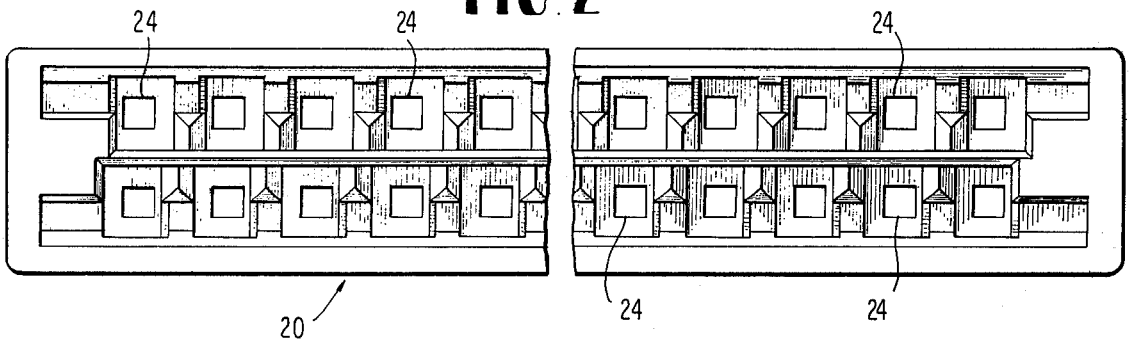
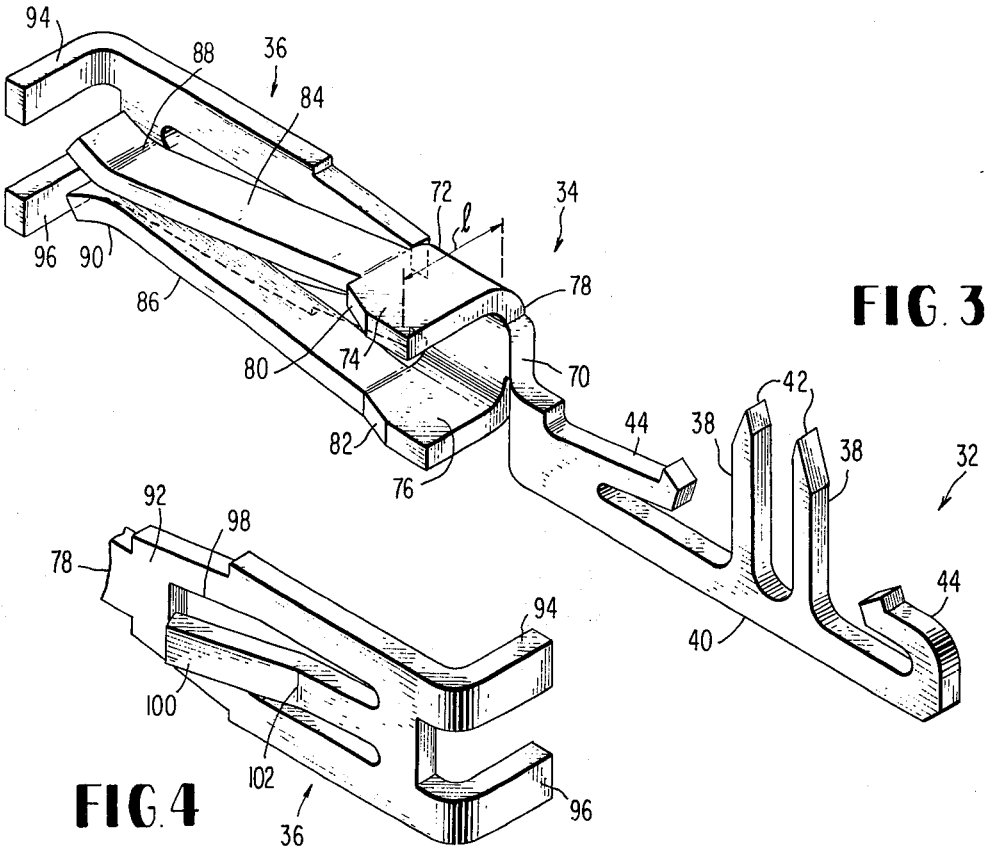
FIG. 3
FIG. 4

FIG. 7
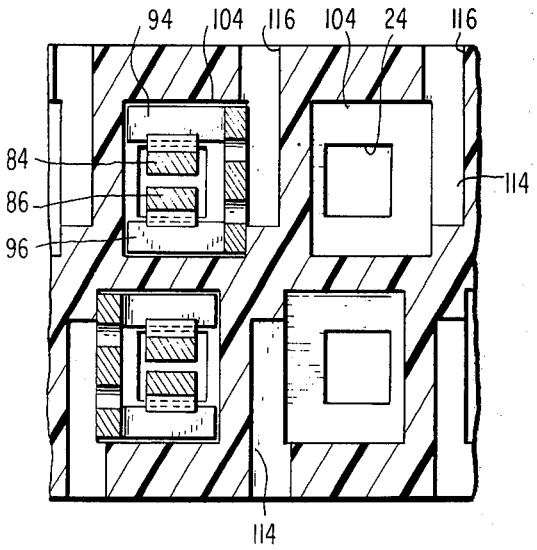
FIG. 8
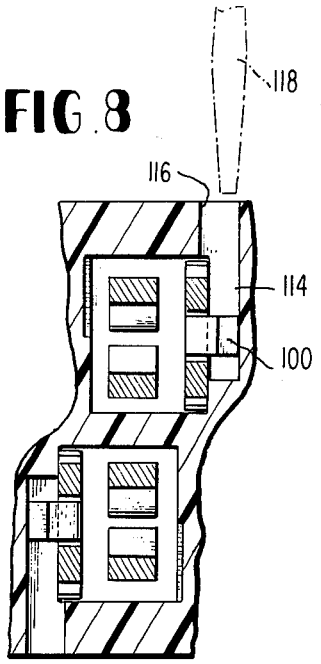
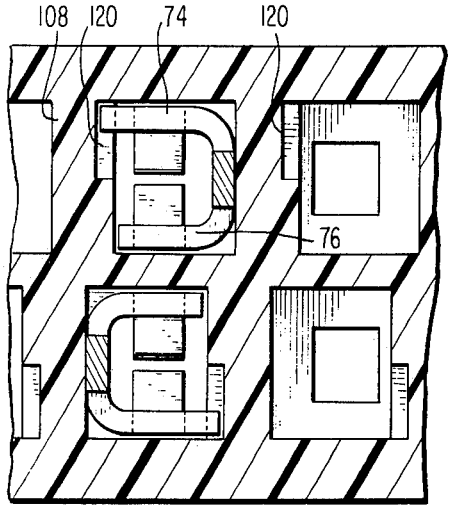
FIG. 9
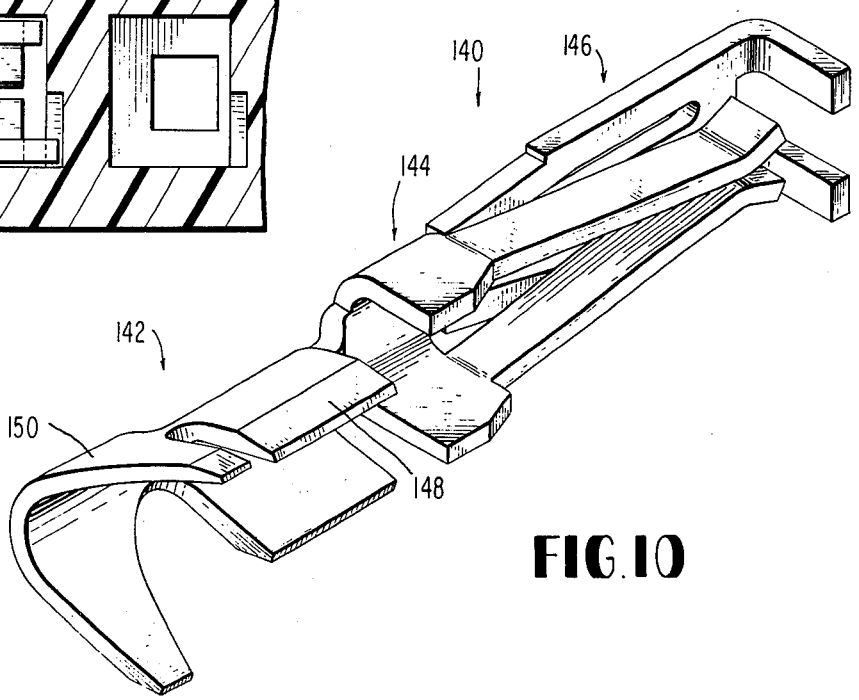
FIG. 10

TERMINATING APPARATUS FOR FLAT CONDUCTOR CABLES

RELATED PATENTS

This application relates to commonly assigned applications Ser. No. 465,594, filed Apr. 30, 1974, for "Method and Apparatus for Flat Conductor Cable Termination," by Charles E. Baker and Abraham Silverweig, application Ser. No. 465,593, filed Apr. 30, 1974, for "Flat Cable Termination Method and Apparatus," by Kenneth Mumshower, now U.S. Pat. No. 3,924,917, issued Dec. 9, 1975; and application Ser. No. 224,549, filed Feb. 8, 1972, for "Square Pin Receptacles Employing Channel Contacts," by Russel H. Mathews, now U.S. Pat. No. 3,711,819, issued Jan. 16, 1973.

BACKGROUND OF THE INVENTION

The present invention relates to multiple contact connectors. More particularly, the invention pertains to multiple contact connectors for the termination of flexible flat conductor cable, ribbon cable, flexible etched circuitry, and the like.

Conventionally, the term "flexible flat conductor cable" is used to designate a cable having a plurality of relatively thin, flat, ribbon-like conductors embedded in an insulative polyester medium wherein the conductors lie in a generally mutually parallel and coplanar posture. The term "ribbon cable" commonly denotes a plurality of generally round wires embedded in an insulation medium wherein the axes of the wires are coplanar. In the description and claims which follow, "flat conductor cable" is used as a term which is intended to generically denote both of the above-noted types of cable as well as flexible etched circuitry and the like.

Flat conductor cable is currently being utilized in wiring applications to an increasing extent as a result of its compactness and advantageous electrical characteristics. For example, it has been found that this type of cable may facilely be installed and removed under relatively crowded conditions which would render other conventional wiring arrangements costly, burdensome and subject to errors. More particularly, flat conductor cable finds utility, when terminated with a plurality of contacts, by being plugged onto a printed circuit board or similar type structure having a plurality of closely spaced receiving pins. In another version, such conductor cable may be mounted on the edge of a printed circuit module card to provide the card with a single or double row of female contacts such that the card in turn may be plugged onto a larger printed circuit motherboard.

While a substantial commercial need exists in the industry for connecting flat conductor cable to printed circuit boards and the like, the commercial utility of such cable has been hampered by the lack of a particularly suitable terminating apparatus.

An assembly which is operable to terminate flat conductor cable presents at least tow significant problems. One difficulty is occasioned in connecting terminating assembly contacts to the flat conductor cable. A second difficulty is occasioned in dealing with the free ends of individual contact units intended to be operably mated to compatible contact means.

The first segment of the two-prong difficulty is advantageously alleviated by application of methods and apparatus in accordance with the disclosure set forth in the foregoing related applications.

The latter part of the above-noted two-fold difficulty is the primary subject matter of the present invention. In this connection it would be highly desirable to provide an individual box contact and a terminating apparatus of the type wherein an insulation housing is provided to secure in an accurately spaced array a plurality of closely spaced contacts and insulate the contacts from each other.

In effecting the foregoing, flat conductor cable termination housings have been designed as generally rectangular structures including an array of numbered apertures. A corresponding numbered conductor of the flat conductor cable must be inserted within the proper aperture in order to ensure function of the assembly in accordance with design expectations. It has been found, however, that it is difficult to accurately detect during assembly if the flat conductor cable is being installed within an insulation housing with 180° reverse polarity. Accordingly, it would be highly desirable to ensure proper polarity installation of a flat conductor cable within an insulation housing.

Additionally, it would be advantageous to ensure longitudinal retention and concomitant relatively immobile longitudinal containment of individual box contact members within an insulation housing. In a similar vein, it would be desirable to provide a termination assembly wherein individual contact units may be readily disassembled from an associated insulation housing structure without bending or destroying the individual contact units.

It would further be desirable to provide a termination assembly wherein flexible flat conductor cables secured to box contacts in a manner described in the above-identified Baker et al and Munshower disclosures would experience a heightened degree of electrical contact and structural integrity between the individual conductors and box contacts.

OBJECTS AND BRIEF SUMMARY OF THE INVENTION

Objects

An object of the present invention is to provide a novel terminating apparatus for flat conductor cable which is operable to secure in an accurately spaced array a plurality of box contacts and insulate the contacts from one another.

It is another object of the invention to provide a novel apparatus for terminating a flat conductor cable wherein box contact units are securely connected to individual conductors of the flat conductor cable and in turn are securely locked with an insulating housing.

It is a related object of the invention to provide a novel apparatus for terminating flat conductor cables wherein individual box contact units connected to conductor members of a flat conductor cable are longitudinally immobilized within an insulating housing.

It is another related object of the invention to provide a novel terminating apparatus for flat conductor cable wherein individual box contact units retained within an insulating housing may be readily released without damaging the contact members.

It is a further object of the invention to provide a novel terminating apparatus for flat conductor cable wherein the conductor cable is readily connectable to an insulation housing with a predetermined polarity.

It is still a further object of the present invention to provide a novel terminating apparatus for flat conductor cable of the "flexible flat conductor cable" type wherein an increase in contact bias is achieved between individual cable conductors and an associated box contact unit upon insertion of the contact within an insulation housing.

BRIEF SUMMARY

A terminating apparatus for flat conductor cable according to a preferred embodiment of the invention which is intended to substantially accomplish the foregoing objects includes a generally rectangular insulation housing having an array of longitudinally extending apertures spaced with relatively close centers in a mutually parallel and coplanar posture. A box contact unit is positioned within each housing aperture and includes a contact tail for providing a secure structural and electrical connection to an associated one of a plurality of individual conductors of a flat conductor cable. Each box contact further is comprised of a contact nose for providing a releasable electrical connection to another associated one of a plurality of mating conductors.

Each contact assembly is fashioned with a resilient locking lance which operates in cooperation with a recess fashioned within one wall of each housing aperture to releasably maintain the flexible conductor cable within the insulation housing. Further, the insulation housing is fashioned with a plurality of releasing windows one of which normally opens into each recess fashioned within one wall of each insulation housing aperture. This window permits insertion of a releasing tool which is operable to remove the resilient locking lance from cooperation with the aperture recess.

Each box contact is further fashioned with a transversely extending leg which operates in cooperation with a longitudinally extending recess in each housing aperture to ensure proper polarization or orientation during insertion of the box contacts within the generally rectangular insulation housing.

When the flat conductor cable comprises a "flexible flat conductor cable" and the contact units are fashioned in accordance with structures disclosed in the previously identified Baker et al and Munshower disclosures, an inwardly projecting, longitudinally extending ridge is fashioned within the insulation housing to flex the conductor cable inwardly and increase contact bias between each conductor and an associated box contact member.

THE DRAWINGS

Other objects and advantages will become apparent when the present invention is considered with reference to the following detailed description of a preferred embodiment thereof taken in connection with the accompanying drawings wherein like references refer to like parts in which:

FIG. 1 is a front elevational view of a "box connector" insulation housing, including dual rows of closely spaced apertures having mutually parallel and coplanar axes;

FIG. 2 is a rear elevational view of the insulation housing disclosed in FIG. 1;

FIG. 3 is an axonometric view of one preferred embodiment of a box contact unit operable to connect to an individual conductor of a flat conductor cable;

FIG. 4 is a partial orthogonal view of the front end of the box contact disclosed in FIG. 3 and particularly discloses a locking lance projecting outwardly from a wall surface of the contact;

Figure 5:
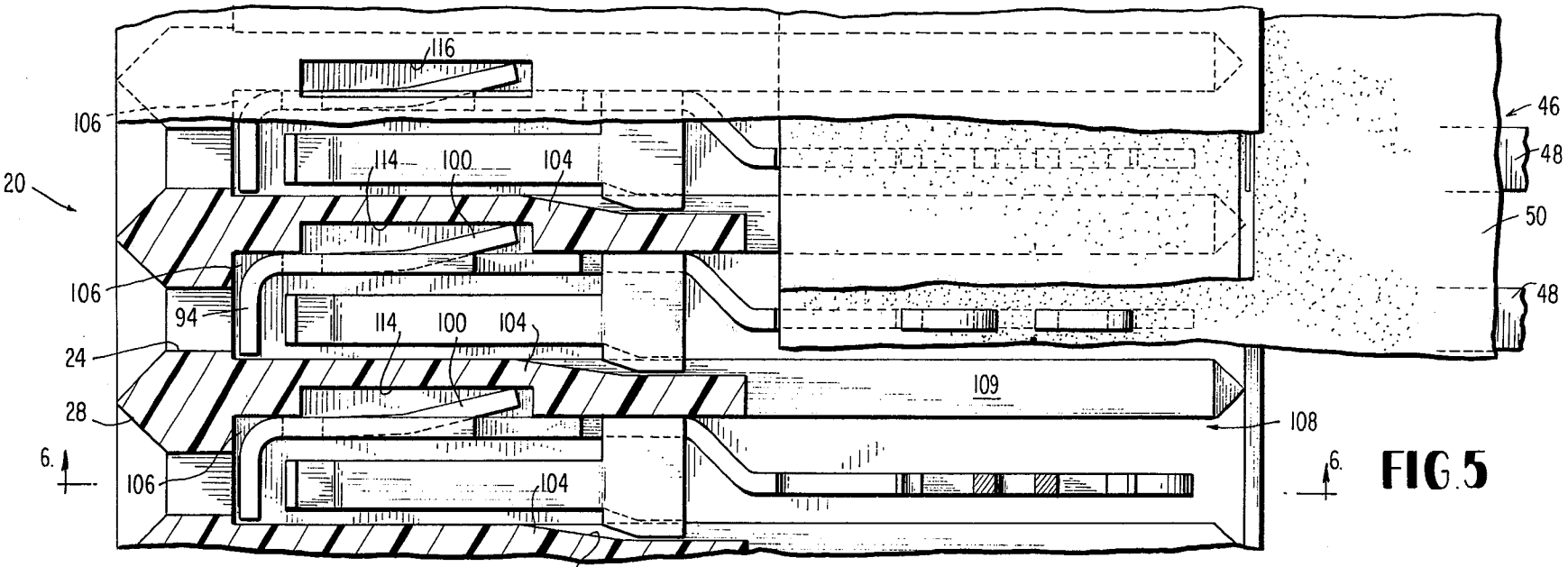
FIG. 5 is a partial plan view of a flat conductor cable, partially broken away, connected to box contacts which in turn are inserted within an insulation housing.
Figure 6:
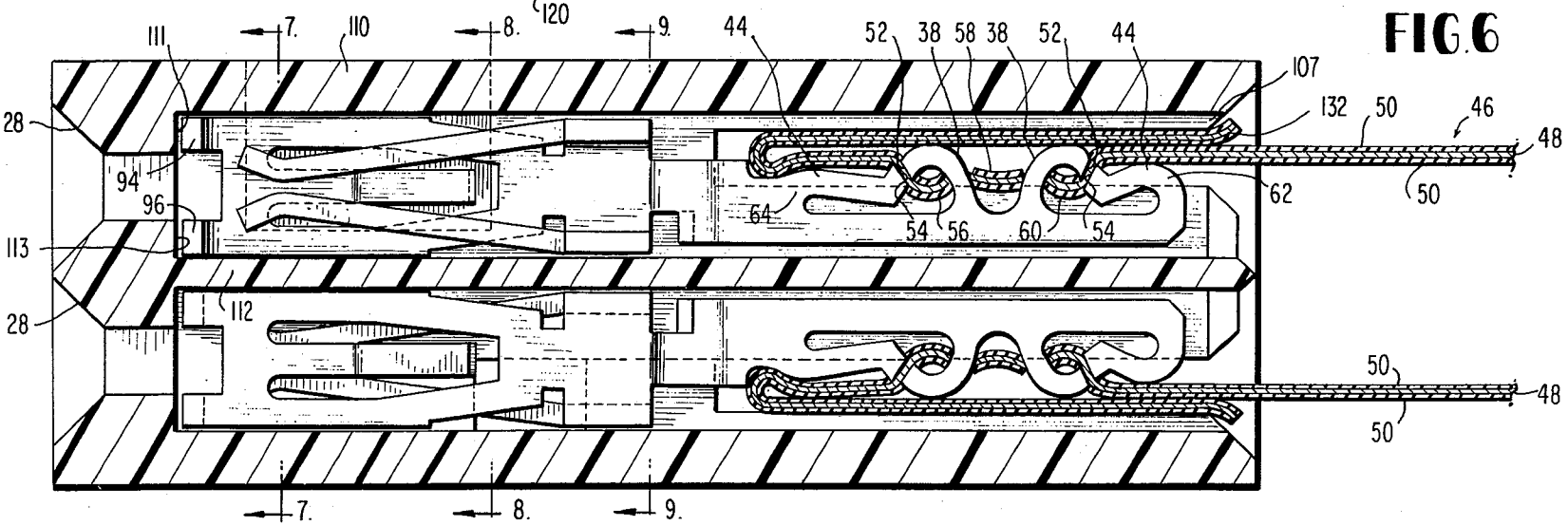
Figure 5A:
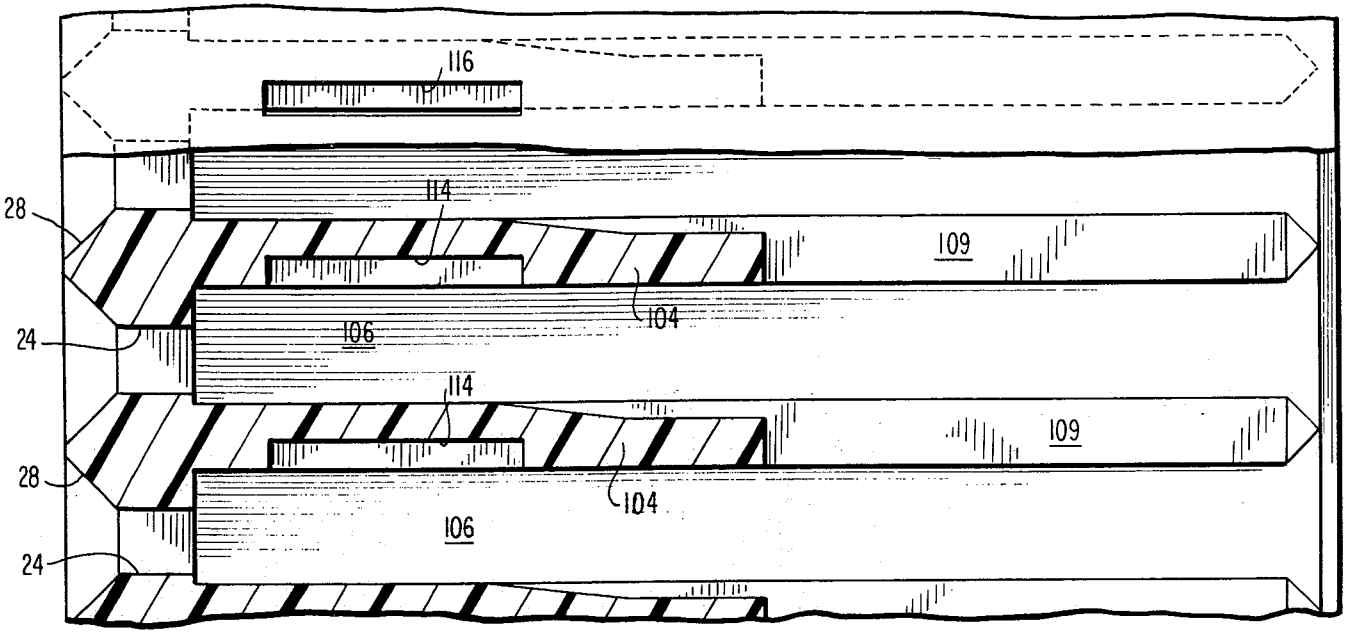
Figure 6A:
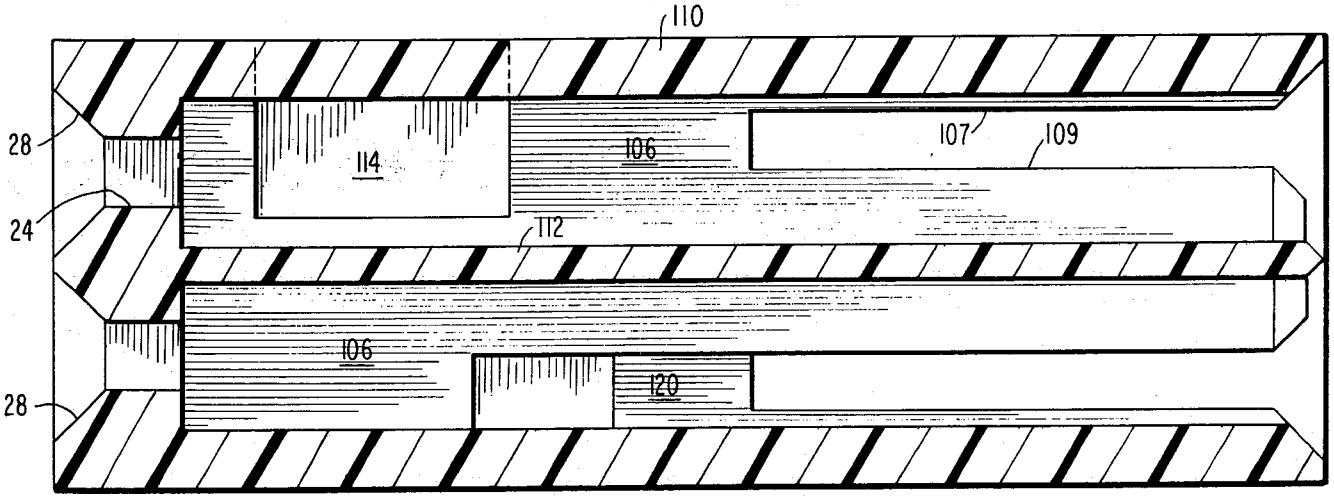

FIG. 5*a* is a view similar to FIG. 5 with the flexible flat conductor cable and associated box contacts removed in order to more clearly disclose the internal structure of the insulation housing;

FIG. 6 is a cross-sectional view taken along section lines 6—6 in FIG. 5 and discloses a terminating apparatus in accordance with a preferred embodiment of the invention incorporating a pair of flexible flat connector cables;

FIG. 6*a* is a view similar to that disclosed in FIG. 6 with the removal of the flexible flat connector cable and associated box contacts to more clearly disclose the internal structure of the insulation housing;

FIG. 7 is a cross-sectional view taken along section lines 7—7 in FIG. 6 and illustrates box connector contact tines generally aligned with apertures in the insulation housing;

FIG. 8 is a cross sectional view taken along section lines 8—8 in FIG. 6 and particularly illustrates a window for insertion of a releasing tool prior to removal of the box contacts from the housing assembly;

FIG. 9 is a cross-sectional view taken along section lines 9—9 in FIG. 6 and particularly illustrates a long leg of a pair of legs orthogonally projecting from one wall of the contact which cooperates with a recess within a partition of the insulation housing to ensure proper orientation of a flat conductor cable with the insulation housing; and FIG. 10 is an axonometric projection of an alternate preferred box contact assembly of the type which is particularly adapted for use with ribbon cable assemblies and individual wires.

DETAILED DESCRIPTION

Insulation Housing

With particular reference now to FIGS. 1 and 2 of the drawings, there will be seen front end rear elevational views of a dual row box contact insulation housing 20 in accordance with a preferred embodiment of the invention.

A mating surface 22 of the insulation housing is fashioned with a plurality of generally square apertures 24. The apertures are formed in closely spaced dual rows wherein axes 26 of the apertures extend in a mutually parallel and coplanar posture.

Each of the apertures 24 is preceded by an entrance cavity bounded by inwardly sloping quadrant surfaces 28. Surfaces 28 function to contact and guide mating prongs connected to a printed circuit board or the like into the apertures 26. This guiding and aligning function reduces any tendency for one or more skewed male contact members from engaging relatively delicate box contact units positioned within the interior of the insulation housing in a damaging or destructive manner.

FIG. 2 depicts a rear elevational view of the insulation housing 20 wherein intricate entrance surfaces are disclosed for the reception of a plurality of box contact members connected to individual conductors of a flexible conductor cable. The internal structure of the insulation housing will be described in detail hereinafter.

The box contact housing is molded from an insulation material which in one preferred form comprises a thermoplastic polyester filled with 30 percent glass fibers for strength.

FIGS. 1 and 2 illustrate a dual row box contact insulation housing which in many instances is preferred. It will be appreciated, however, that a single row box contact housing is also contemplated by the subject invention wherein a single array of closely spaced apertures are desired for a terminating assembly.

BOX CONTACT

With reference now to FIGS. 3 and 4, there will be seen axonometric views of a box contact unit 30 in accordance with the subject invention. Each contact unit 30 includes a tail section 32, a bridging section 34 and a nose section 36.

The tail section 32 is particularly disclosed in the previously identified Baker et al and Munshower disclosures. Accordingly, these disclosures are hereby incorporated by reference as though set forth at length. Briefly, however, the tail section 32 includes a pair of prongs 38 which are carried by a base portion 40 and have sharpened or pointed distal ends 42. The base portion 40 also carries a pair of resilient abutment arms 44 which operate in cooperation with the prongs 38 to form a secure mechanical and electrical contact with an individual conductor in a flexible flat conductor cable.

More particularly in this connection, and with reference to FIGS. 5 and 6, there will be seen a segmental view of a flexible flat conductor cable 46. The cable 46 is comprised of a plurality of parallel and spaced apart, generally ribbon-like conductors 48. These ribbon-like conductors are embedded in an insulating film 50 of a polyester or similar material. Mylar (polyethylene terephthalate), Kapton (a polyimide), and Teflon (polytetrafluoroethylene) are typically used as insulation material in flexible flat conductor cables. It is envisioned that these and a variety of other similar materials would be suitable.

In order to effect a secure mechanical and electrical connection of the tail portion 32 with the individual conductors 48, a suitable tool (not shown) is used to effect a penetration of the conductor 48 and insulation film 50 by the prongs or piercing arms 38. The tool is then operable to bend the arms approximately 180°, note particularly FIG. 6, and again penetrate an upper film surface of the cable to effect intimate electrical contact by an endmost chamfered surface 52 of each prong with an upper surface of an associated conductor 48. During the previously noted piercing and bending operation, chamfered end portions 54 of the abutment arms 44 piece the lower film surface of the cable and intimately engage the lower surface of the associated contact 48.

From the foregoing, it will be appreciated that electrical contact is made between the conductor 48 and the tail 32 at several engaging locations, viz., between each of the bent prongs 38 and the conductor 48 adjacent a top surface of the conductor and between each of the chamfers 54 and the conductor 48 adjacent its bottom surface. Additionally, each of the prongs 38 is intimately wiped at the penetration junction of the prong through the conductor cable. The exact nature of the electrical contact between the prongs and the conductor and between the reaction surfaces and the conductor may vary depending upon circumstances. At any rate, surface contact, edge contact, and/or point contact with the conductor is provided at several engaging locations.

Intimate mechanical and electrical contact is maintained with the conductor 48 and facilitated substantially throughout the life of the unit through a biasing action of the insulation material at conductor bridge locations 56, 58, and 60 and also through the resiliency inherent in the bent zones 62 and 64 of the abutment arms 44.

With renewed attention invited to FIG. 3, it will be appreciated that the tail section 32 meshes into a bridging section 34 of the box contact member 30.

The bridging section 34 includes a connecting member 70 which serves to join the tail section 32 and a generally U-shaped section 72 of the bridge. The U-shaped section includes a first leg 74 and a second leg 76 interconnected by a normally extending wall or bight portion 78. The distal ends of legs 74 and 76 are fashioned at forward edges thereof with chamfers 80 and 82, respectively, which serve to guide and align entrance of the contact unit within the insulation housing 20. Moreover, leg 74 is fashioned with a greater longitudinal length l to facilitate proper polarization during mating between the box contact and the housing 20 in a manner to be discussed more fully hereinafter.

The nose section 36 of the connector 30 includes a pair of contact tines or leaves 84 and 86 which are cantilevered from forward edges of the legs 74 and 76, respectively. The tines 84 and 86 are mutually inclined inwardly at the distal ends thereof and are bent slightly upwardly as at 88 and 90 to present a smooth entrant zone for the reception of a square male contact prong. The leaves or tines 84 and 86 possess an intrinsic resilient bias to maintain the distal ends in a closed posture thus ensuring electrical contact when a connector pin is inserted between the leaves.

With reference to FIGS. 3 and 4, the contact nose section 36 further includes a generally planar wall portion 92 integrally connected to the bight 78 of the bridging 34. The wall portion 72 is bifurcated at the distal end thereof into table legs 94 and 96 which are orthogonally bent with respect to the wall 92. The table legs 94 and 96 cooperate in a manner to be discussed hereinafter with a front wall surface of the insulating housing to limit forward motion of the contact within the housing.

The wall 92 is further fashioned with a cut out portion 98 which defines a locking lance 100. Lance 100 is bent outwardly as at 102 with respect to the wall surface 92 and serves to engage a locking recess within the insulator housing.

The combination of the table legs and locking lance function to longitudinally secure or immobilize the contact unit 30 within the insulation housing.

It is contemplated that a variety of relatively thin sheet metallic materials, which are electrically conductive, may be utilized to fabricate the box contact 30. A preferred material, however, is a brass alloy 688 which has been found to be structurally rugged and resilient to light deflections. By way of fabrication, the contact 30 is typically stamped from a relatively thin blank and appropriately bent and fashioned into the structure axonometrically depicted in FIG. 3.

TERMINATING ASSEMBLY

With particular reference now to FIGS. 5–9, there will be seen various detailed views of the insulation housing 20 and a plurality of individual box contacts 30 in an interconnected posture which operably function to provide a highly advantageous terminating assembly for a flat conductor cable 46.

The insulation housing assembly depicted in these figures and as previously noted in connection with FIGS. 1 and 2 preferably is constructed with dual rows or upper and lower tiers of apertures.

The following discussion will particularly deal with the internal structure and attachment of box connectors of the upper tier of apertures. All that is discussed, however, in connection with the upper tier will be applicable to the lower tier. The sole difference between the two tiers is a 180° reversal of elements.

With particular reference to FIGS. 5, 5*a*, and 7, it will be seen that in cross-section the insulation housing 20 is segmented by normally extending partitions 104 into a forward generally enclosed portion 106 and a rearward generally open portion 108.

The forward portions 106 are generally rectangular in cross-section as defined by partitions 104 and upper and lower walls 110 and 112, respectively. The partitions 104 longitudinally extend as a solid wall to approximately a mid portion of the insulation housing and thus serving to define in a forward portion of the housing generally rectangular openings in substantial alignment with the apertures 24 for the reception of the nose portions 36 of individual box contact members. As will be seen in FIG. 7 the contact tines 84 and 86 of the box contact are coaxially positioned with respect to the apertures 24. The partition 104 in a rearward portion of the housing is split or open by a recess defining upper and lower flanges or legs 107 and 109 extending from the top and bottom walls 110 and 112, respectively. This open structure enables a continuous flexible flat conductor cable including the tail portions 32 of the box contact units 30 to be received within the insulation housing, note particularly FIG. 6.

Each of the partitions 104 is fashioned with a generally rectangular recess 114 which operably receives the distal end of locking lance 100 when a box contact 30 is inserted within the forward enclosed portion of the housing 106. The table legs 94 and 96 abut against internal end surfaces 111 and 113 of the housing. As previously noted, the combination of the locking lance 100 and table legs 94 and 96 serve to longitudinally fix the box contact within the insulation housing.

From time to time it has been found desirable to release the flexible flat connector cable and the associated plurality of box contacts from the insulation housing. In this regard, a plurality of releasing windows 116 are fashioned through the insulation housing outer surfaces and look directly into recesses 114.

With particular reference to FIG. 8, it will be appreciated that windows 116 provide an access port for the insertion of a removal tool 118 which may be inserted into the wall recess 114 and deflect locking lance 100 inwardly so that the flexible flat conductor cable and box contacts may be removed.

It will also be appreciated that the deflection of locking lance 100 by removal tool 118 is limited by the edge walls of the windows 116, inasmuch as the locking lance 100 must be moved in a direction parallel to the longitudinal extent of the housing 20. This unique design prevents accidental damage to the contacts 30 during removal thereby avoiding the necessity for reconstructing the entire terminating of contacts to the flexible flat conductor cable. While various tool designs are envisioned, one such structure may take the form of a comb having spacings compatible with the spacing of windows 116 along the outer surface of the insulation housing.

With particular reference now to FIGS. 5, 6, and 9, there will be seen detailed views of a structure for ensuring proper orientation or polarity of insertion of the flexible flat conductor cable with respect to the insulation housing. More particularly, the insulation housing is typically designed with a designated orientation or sequence for matching with the individual conductors in the cable. The apertures, for example, in the upper tier may be numbered consecutively 1–35 and in the lower tier 36–70. During assembly, however, it is not uncommon for the cable to have been turned 180° or with reverse polarity to design orientation. The subject invention alleviates this vexing problem. In this connection, the partitions 104 are fashioned on one surface thereof with a recess 120. This recess operably receives the long leg 74 of the generally U-shaped section while the short leg 76 is received along the normal partition wall surface.

The foregoing described long and short leg structure of the U-shaped section of bridge member 34 in cooperation with the recess 120 prevents the box contact from being inserted within the forwardmost portion 106 of the housing in a reverse polarity by the leg abutting against the partition wall. Accordingly, upon meeting resistance to insertion of the box contact within the insulation housing an operator is alerted to flip the flexible flat conductor cable over and thus reverse the polarity 180° whereupon the box contacts will be fully received within the insulation housing.

When utilizing the terminating apparatus with flexible flat conductor cables such as illustrated in FIGS. 5 and 6, the interior of the insulation housing further functions in a synergistic capacity in that downwardly projecting ridges 107 fashioned from a portion of partition 104 serves to depress in a wave-like pattern a folded-over portion 132 of the flexible flat conductor cable. While this folded-over portion 132 is not required (the contacts may be connected to an edge of the flat conductor cable) it does permit intermediate or auxilliary connections along the flat conductor cable without breaking the continuity of the cable. This is sometimes referred to as "daisy-chaining." This downward deflection of the cable portion 132 impinges upon the uppermost portion of stems 38 and further enhance resilient contact of the tail end 32 of the connector with the individual conductor strips 48.

While the foregoing discussion has been with particular reference to a flexible flat conductor cable, as previously noted, the subject invention is intended to be operable with other cable constructions such as "ribbon cable," individual round wires, and the like. In the event ribbon cable is utilized, the individual round conductors may be conveniently terminated by box contacts 140 such as axonometrically illustrated in FIG. 10.

More particularly, the box contact 104 includes a tail section 142, a bridging section 144, and a nose section 146. The bridge and nose sections are identical to bridge and nose sections 34 and 36 as illustrated and described in connection with FIG. 3. Accordingly, that description is repeated by reference as though set forth at length.

The difference in the two box contact structures entails the particular tail structure 142 and in this regard FIG. 10 discloses embracing wings or grasping tabs 148 and 150 which may be securely wrapped around a prepared circular conductor end and a surrounding insulation, respectively. The tail structure 142 is of a conventional design and is connected to the end of stripped wire by a conventional crimping tool. For a further description of this type of tail structure in combination with a box contact reference may be had to the above-identified Matthews Patent. It will be appreciated that box contacts 140 terminated to individual wires, may be used exclusively or in combination in the same insulator housing with flexible flat coductor cable to greatly increase the design flexibility of the present invention.

SUMMARY OF THE MAJOR ADVANTAGES OF THE INVENTION

In describing a terminating assembly and box contact structure according to the present invention, several advantages have been specifically and inherently disclosed. Nonetheless a brief summary of major advantages at this point may be both useful and appropriate.

A significant advantage of the present invention is the provision of a plurality of box contact units connected to a flat conductor cable which may be advantageously inserted and held within an insulation housing having at least one array of closely spaced apertures having mutually parallel and coplanar axes.

Another advantage of the present invention comprises the provision of a box contact which may be structurally and electrically securely connected to individual conductors of a flat conductor cable and securely retained through the provision of lance and recess structures within an encompassing insulation housing.

A related advantage of the invention is the provision of the combination of table legs, lance and recess structures to longitudinally immobilize the box contact within closely spaced chambers of the insulation housing.

A further related aspect of the invention is the provision of a plurality of windows fashioned through the insulation housing and looking into the locking recesses to permit insertion of a tool to facilitate removal of the insulation housing from encompassing engagement with the plurality of box contact units.

A further significant advantage of the present invention is the provision of the U-shaped portion of the bridging network including long and short legs which cooperate with recesses fashioned within partitions of the insulation housing to ensure proper polarization of the individual connectors with respect to numbered chambers of the insulation housing by preventing improper insertion of the box contact units within the insulation housing.

Yet a further significant advantage of the invention resides in the provision of ribs operable to cooperate with a portion of a flexible flat conductor cable to enhance the mechanical and electrical contact of a terminating assembly with an associated conductor.

In describing the invention reference has been made to a preferred embodiment. Those skilled in the art, however, after becoming familiar with the disclosure of the invention, may recognize additions, deletions, substitutions or other modifications which will fall within the purview of the invention as defined in the following appended claims.

What is claimed is:

1. Contact apparatus for conductor means comprising:

contact tail means for simultaneously providing a secure structural and electrical connection to an associated conductor;

contact nose means for providing a releasable electrical connection to another associated mating conductor contact means; and bridge means for connecting said contact tail means with the contact nose means to provide a unitary contact apparatus, wherein said contact nose means includes a pair of opposed contact tines resiliently cantilevered from said bridge means in a direction away from said contact tail means, said tines being mutually self-biased together at the free end thereof for providing said releasable electrical connection with the another associated mating conductor contact means, wall means longitudinally extending from said bridge means along at least one side of said pair of opposed contact tines in a posture contiguous to but spaced from said pair of opposed contact tines, and lance means formed by a portion of said at least one wall means and resiliently cantilevered to one side of said contact away from said pair of opposed contact tines, said lance means being oriented in the general direction of said contact tail means, said lance means being operable to resiliently engage a correspondingly locking recess fashioned within an insulator housing for selectively retaining said contact apparatus within an insulator housing, said bridge means including:

a pair of spaced, parallel legs extending transversely relative to said wall means to another side of said contact other than the side to which said lance means is cantilevered, one of said legs being dimensioned differently than the other for being operably received within a correspondingly dimensioned recess fashioned within an insulator housing to permit insertion of the contact apparatus within an insulator housing only in accordance with a predetermined orientation;

said opposed contact tines being integral with respective ones of said legs and projecting therefrom in a direction away from said contact tail means.

2. Contact apparatus for conductor means as defined in claim 1 wherein said one of said legs is longer than the other for being operably received within a corresponding recess fashioned within an insulator housing to permit insertion of the contact apparatus within an insulator housing only in accordance with a predetermined orientation.

3. Contact apparatus for conductor means as defined in claim 2 and further comprising:

a pair of front table legs orthogonally projecting from said wall means across the free ends of said pair of opposed contact tines, said table legs being operable to contact a front face of an insulated housing means and serving in combination with said lance means to longitudinally immobilize said generally flat conductor cable means within said insulation housing means.

4. Electrical connector apparatus comprising:

a generally flat conductor cable having a plurality of coplanar individual conductors, a generally rectangular insulation housing means having a forward portion carrying an array of longitudinally extending apertures with mutually parallel and coplanar axes, and a generally open rearward portion communicating with said apertures;

a plurality of contact means for each housing aperture, each including contact tail means disposed in said housing rearward portion and simultaneously providing a resilient structural and electrical connection to an associated one of said plurality of cable conductors, said tail means being secured to said cable at a location remote from the terminal end of said cable, with a terminal end section of said cable being folded over upon itself opposite said tail means in said housing rearward portion;

contact nose means disposed within an associated housing aperture for providing a releasable electrical connection to another associated one of a plurality of mating conductor contacts, and bridge means for connecting said contact tail means with said contact nose means to provide a unitary contact apparatus;

said housing rearward portion further including a plurality of ridge means projecting in a direction generally perpendicular to the plane of said cable and being in engagement with said folded cable section to depress said folded cable section against the connection between said tail means and said cable conductors to enhance said resilient connection therebetween.

* * * * *